US011286686B2

(12) United States Patent
Rossi

(10) Patent No.: US 11,286,686 B2
(45) Date of Patent: Mar. 29, 2022

(54) FUNERARY CONTAINMENT STRUCTURE FOR FUNERARY OBJECTS

(71) Applicant: BIONDAN NORTH AMERICA INC., Toronto (CA)

(72) Inventor: Filippo Rossi, Isola Della Scala (IT)

(73) Assignee: BIONDAN NORTH AMERICA INC., Toronto (CA)

( * ) Notice: Subject to any disclaimer, the term of this patent is extended or adjusted under 35 U.S.C. 154(b) by 0 days.

(21) Appl. No.: 16/930,717

(22) Filed: Jul. 16, 2020

(65) Prior Publication Data

US 2021/0017785 A1 Jan. 21, 2021

(30) Foreign Application Priority Data

Jul. 16, 2019 (IT) ..... 102019000011826

(51) Int. Cl.
*E04H 13/00* (2006.01)
*A61G 17/08* (2006.01)

(52) U.S. Cl.
CPC ..... *E04H 13/008* (2013.01); *A61G 17/08* (2013.01); *E04H 13/006* (2013.01)

(58) Field of Classification Search
CPC ..... E04H 13/00; E04H 13/006; E04H 13/008; E04H 13/001; A61G 17/00; A61G 17/08
USPC ..... 27/1, 35; 52/134, 136; 211/85.27
See application file for complete search history.

(56) References Cited

U.S. PATENT DOCUMENTS 3,529,730 A * 9/1970 Thompson ..... E04H 13/006 211/85.27
3,754,805 A * 8/1973 Pangburn ..... E04H 13/006 312/111
3,841,726 A * 10/1974 Andros ..... A61G 17/08 312/111
3,905,169 A * 9/1975 Gallo ..... E04H 13/006 52/137
4,484,422 A * 11/1984 Roberts ..... E04H 13/003 52/137
4,614,066 A * 9/1986 Koppenberg ..... E04H 13/006 312/111
5,740,637 A * 4/1998 Snow ..... E04H 13/006 27/1

(Continued)

FOREIGN PATENT DOCUMENTS

EP 1054120 A2 11/2000
EP 2194215 A1 6/2010

OTHER PUBLICATIONS

Italian Search Report dated Mar. 19, 2020 issued in IT 201900011826, with partial translation.

*Primary Examiner* — William L Miller

(74) *Attorney, Agent, or Firm* — Scully, Scott, Murphy & Presser, P.C.

(57) ABSTRACT

A funerary containment structure for funerary objects, which comprises a base structure, which defines at least one niche, which is designed to contain at least one funerary object and has at least one access opening, which is closed by way of at least one slab which is fixed to the base structure; at least one auxiliary device which has a supporting body which is connected to the base structure and supports at least one supporting arm, which extends laterally from the supporting body; fixing elements for fixing at least one ornamental object to the free end of the supporting arm are furthermore provided.

22 Claims, 10 Drawing Sheets

(56) References Cited

U.S. PATENT DOCUMENTS

| | | | | |
|---|---|---|---|---|
| 6,167,600 | B1 * | 1/2001 | Williams | E04H 13/006 27/1 |
| 6,250,025 | B1 * | 6/2001 | Darby | E04H 13/006 52/137 |
| 6,347,439 | B1 * | 2/2002 | Bach Lahor | E04H 13/006 27/1 |
| 10,138,650 | B1 * | 11/2018 | Garcia | E04H 13/008 |
| 2008/0078074 | A1 * | 4/2008 | McCampbell | E04H 13/006 27/1 |
| 2009/0199376 | A1 * | 8/2009 | Hume | E04H 13/006 27/1 |
| 2010/0139060 | A1 * | 6/2010 | Leeder | E04H 13/008 27/1 |
| 2010/0165639 | A1 * | 7/2010 | Skeele | E04H 13/006 362/326 |
| 2010/0300016 | A1 * | 12/2010 | Eickhof | E04H 13/006 52/136 |
| 2011/0030289 | A1 * | 2/2011 | Rossi | E04H 13/006 52/133 |
| 2017/0183889 | A1 * | 6/2017 | Rossi | E04H 13/008 |
| 2018/0202184 | A1 | 7/2018 | Rossi | |
| 2018/0223558 | A1 * | 8/2018 | Birkmeier | E04H 13/006 |
| 2019/0100936 | A1 * | 4/2019 | Moreno | A47F 11/10 |
| 2019/0368219 | A1 * | 12/2019 | Rossi | E04H 13/006 |
| 2020/0232243 | A1 * | 7/2020 | Rossi | E04H 13/006 |

* cited by examiner

FUNERARY CONTAINMENT STRUCTURE FOR FUNERARY OBJECTS

CROSS-REFERENCE TO RELATED APPLICATIONS

This Application claims priority to Application IT 102019000011826 filed on Jul. 16, 2019.

BACKGROUND OF THE DISCLOSURE

The present invention relates to a funerary containment structure for funerary objects.

As is known, in cemeteries funerary containment structures are in use in which funerary objects of various kinds are placed, such as urns, coffins or the like, and which are generally constituted by a base structure which defines a plurality of niches or loculi, which are closed, on their open end, by way of respective slabs made, typically, of stone-like material, such as marble or the like, or of glass.

Optionally, the base structure can be built directly on-site, using masonry and concrete, or it can be obtained by way of assembly of modular components, which are constituted by prefabricated box-like bodies of concrete or metal, each one of which defines a respective niche.

The fixing of the closing slabs of the niches is typically performed using washers, which are connected to the base structure by way of respective connecting elements, such as screws or the like, and which each engage a peripheral region or a corner region of the outward-directed face of at least one respective closing slab.

Normally, ornamental objects, such as vases or tomb lights, are further applied on the outward-directed faces of the slabs.

The fixing of such ornamental objects is commonly performed by way of screws which are screwed into inserts which are inserted into holes which are made for this purpose in the closing slabs.

It is evident that, thus performed, the fixing of the ornamental objects is quite a laborious process.

BRIEF SUMMARY OF THE DISCLOSURE

The aim of the present invention is to provide a funerary containment structure for funerary objects that is capable of improving the known art in one or more of the above mentioned aspects.

Within this aim, an object of the invention is to provide a funerary containment structure that enables an easy application of ornamental objects on the outer face of the closing slabs of the niches.

Another object of the invention is to provide a funerary containment structure that is convenient and simple to assemble.

Another object of the present invention is to provide a funerary structure that makes it possible to fix ornamental objects without requiring holes to be made in the closing slabs of the niches.

Another object of the present invention is to provide an auxiliary device that can be used in funerary containment structures which makes it possible to easily and conveniently mount ornamental objects on the funerary structures themselves.

Another object of the invention is to provide a funerary containment structure that it competitive from a purely economic viewpoint as well.

This aim and these and other objects which will become better apparent hereinafter are achieved by a funerary containment structure for funerary objects according to claim 1, optionally provided with one or more of the characteristics of the dependent claims.

BRIEF DESCRIPTION OF THE SEVERAL VIEWS OF THE DRAWINGS

Further characteristics and advantages of the invention will become better apparent from the description of preferred, but not exclusive, embodiments of the funerary containment structure for funerary objects, according to the invention, which are illustrated for the purposes of non-limiting example in the accompanying drawings wherein.

DETAILED DESCRIPTION OF THE DISCLOSURE

Figure 1:
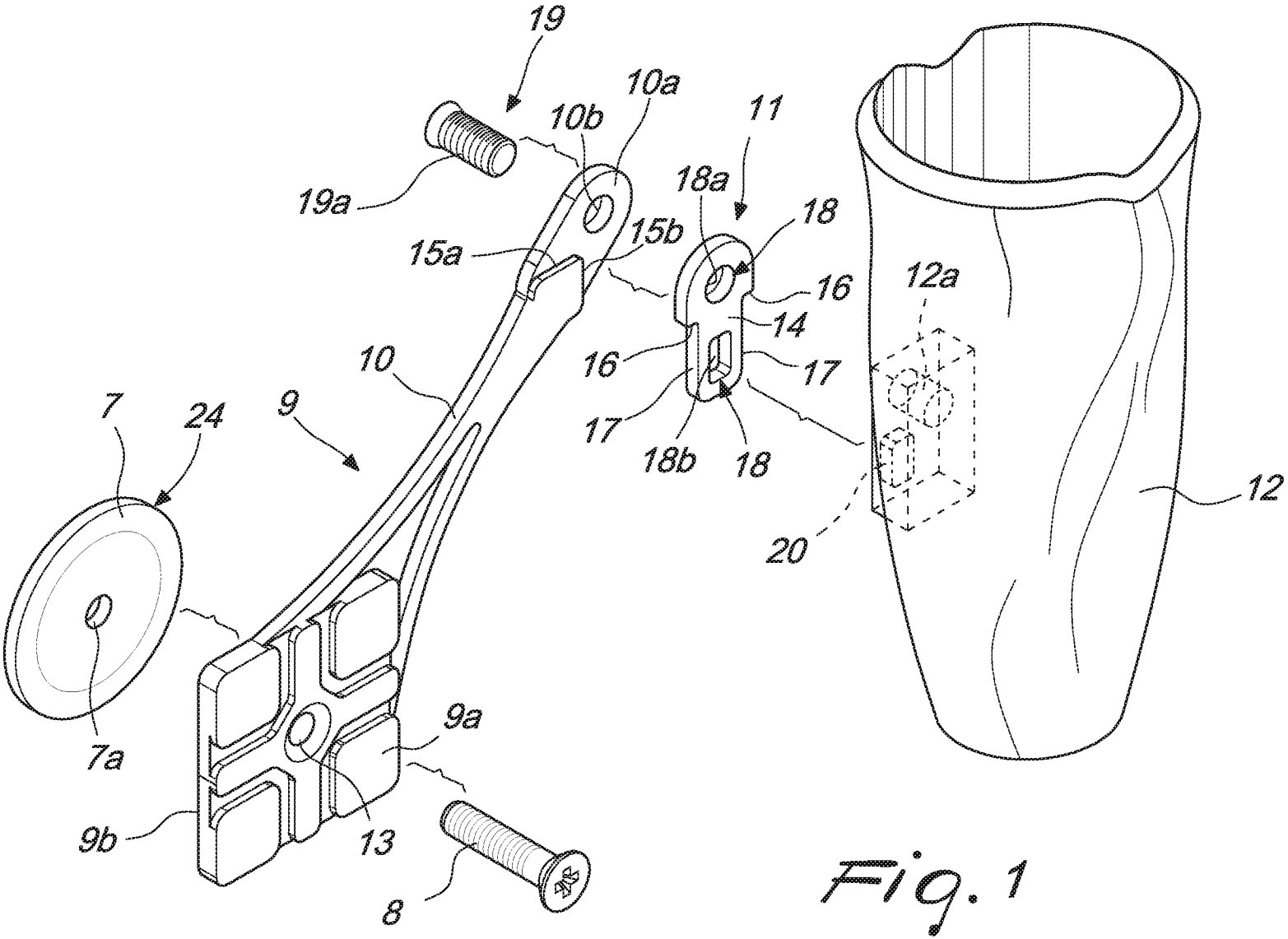
FIG. 1 is an exploded perspective view of an auxiliary device of the structure according to the invention.
Figure 2:
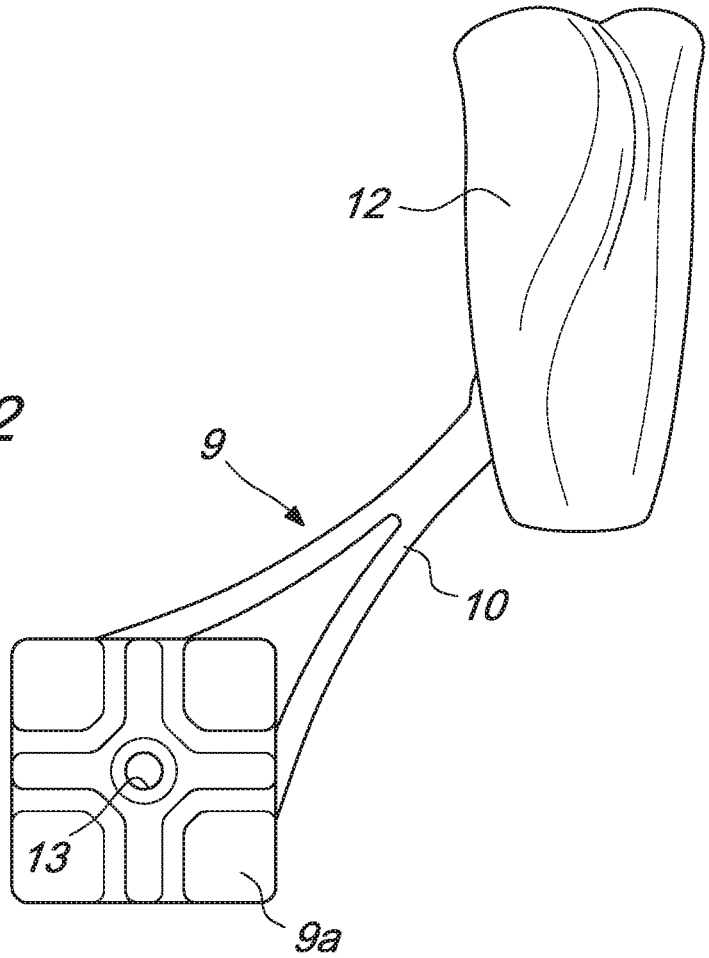
FIG. 2 is a front elevation view of the auxiliary device.

With reference to the figures, the funerary containment structure for funerary objects, according to the invention, generally designated by the reference numeral 1, comprises a base structure 2 which one or more niches 3, which are designed to contain at least one funerary object 4, such as, for example, an urn, a coffin or the like.

Each niche 3 has at least one access opening 5 which is closed by way of at least one slab 6, which can be made of stone-like material, glass or other material and which is fixed to the base structure 2.

In particular, the niches 3 are, preferably, distributed on the base structure 2 according to a matrix arrangement and the respective access openings 5 are defined on an anterior frontal face of the base structure 2.

The peculiarity of the invention consists in that it comprises, for at least one of the niches 3, at least one auxiliary device 9 which has a supporting body 9*a* which is connected to the base structure 2 and which supports at least one supporting arm 10, which extends laterally from the supporting body 9*a*.

The auxiliary device 9 is further provided with fixing means 11 which make it possible to fix at least one ornamental object 12, which is constituted for example by a vase, by a lamp, by a photo frame or the like, to the free end of the supporting arm 10.

In particular, the supporting body 9*a* is connected to the base structure 2 by way of at least one respective connecting element 8, which is constituted, advantageously, by a screw which is screwed into an adapted female thread 8*a*, which is provided in the base structure 2.

Conveniently, the connecting element 8 is inserted into an opening 13 defined, in a preferably central position, in the supporting body 9*a* and is arranged laterally to the slab 6 that closes the niche 3 with which the auxiliary device 9 is associated and, more specifically, it is arranged in a space comprised between the slab 6 of the corresponding niche 3 and the slabs 6 that close the contiguous niches.

Advantageously, the supporting arm 10 of the auxiliary device 9 extends substantially parallel to the outer face of the slab 6 of the niche 3 with which the auxiliary device 9 is associated, so as to be facing toward it.

In particular, the supporting arm 10 extends, starting from an edge region of the supporting body 9*a*, in a substantially radial direction with respect to the axis of the opening 13 which makes it possible to insert the connecting element 8 through the supporting body 9*a*.

Advantageously, the supporting body 9*a* faces, with at least one portion thereof, at least one peripheral region of the face of the slab 6 of the corresponding niche 3 that is directed outward.

Optionally, according to a possible embodiment, it is possible for the supporting body 9*a* to engage such peripheral region of the slab 6 so as to lock, or at least contribute to locking, the slab 6 to the base structure 2.

Figure 8:
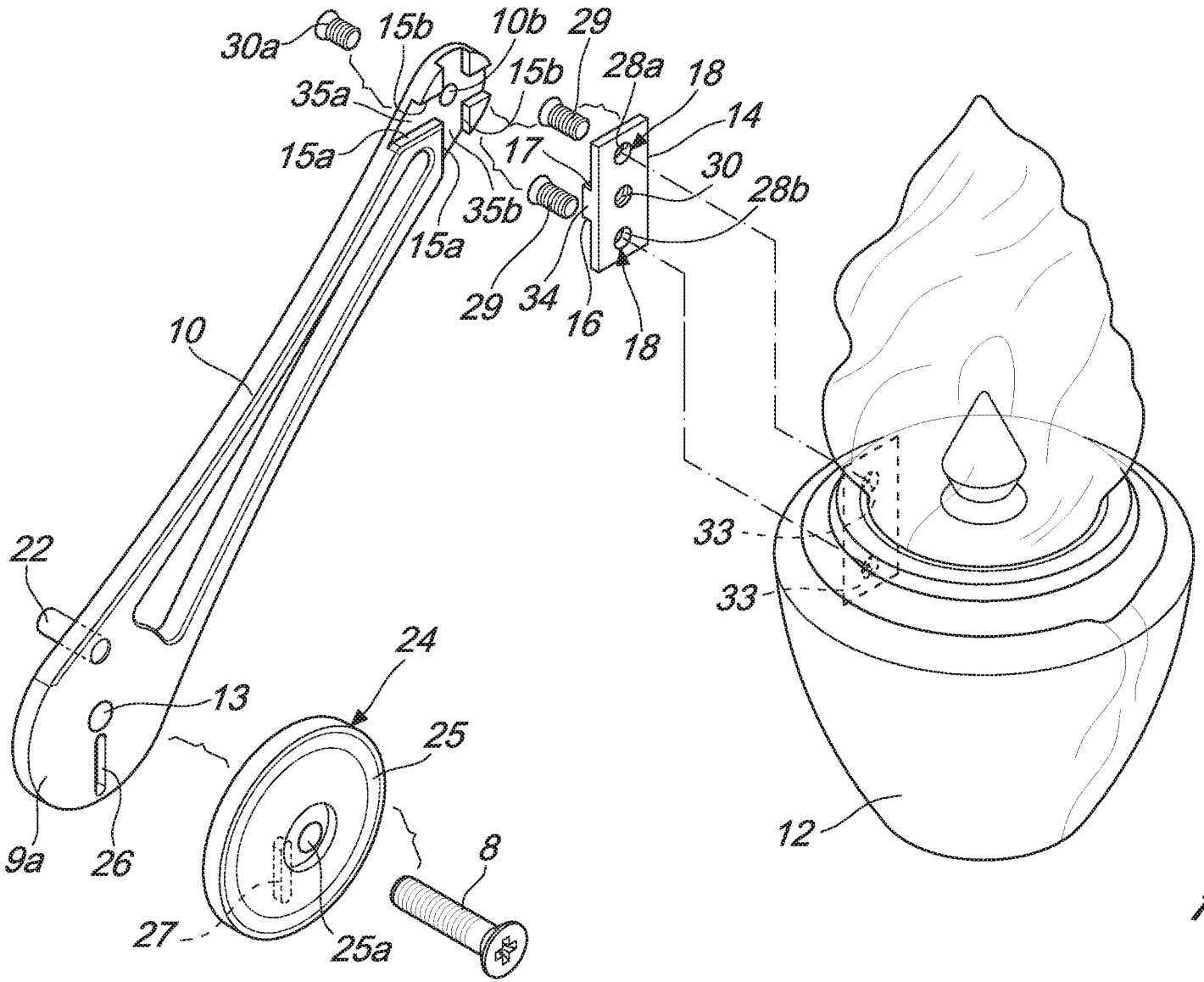
FIG. 8 is an exploded perspective view of a different embodiment of the auxiliary device of the structure according to the invention.
Figure 9:
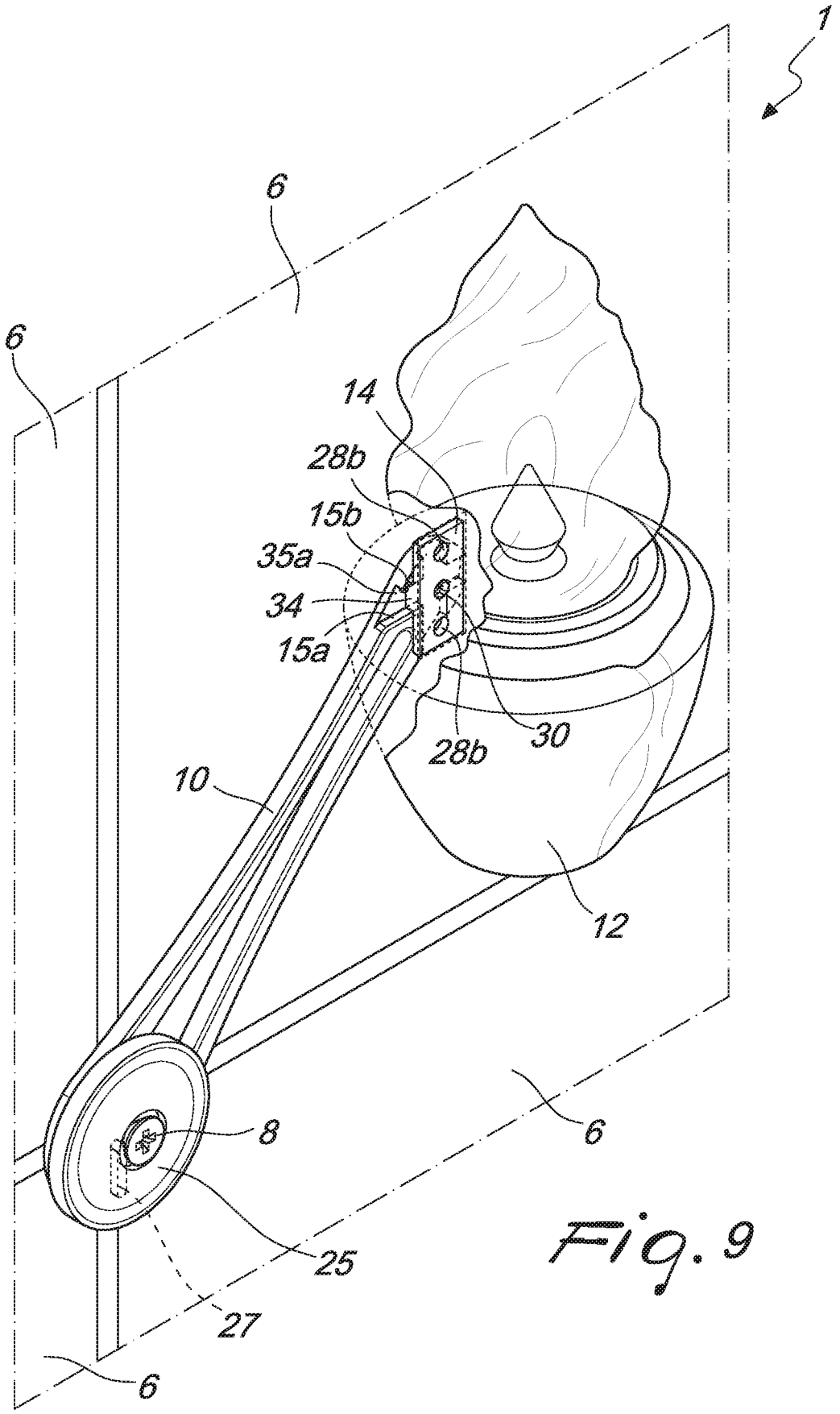
FIG. 9 is a partially transparent perspective view of the embodiment of the auxiliary device of FIG. 8 in the condition for use.
Figure 10:
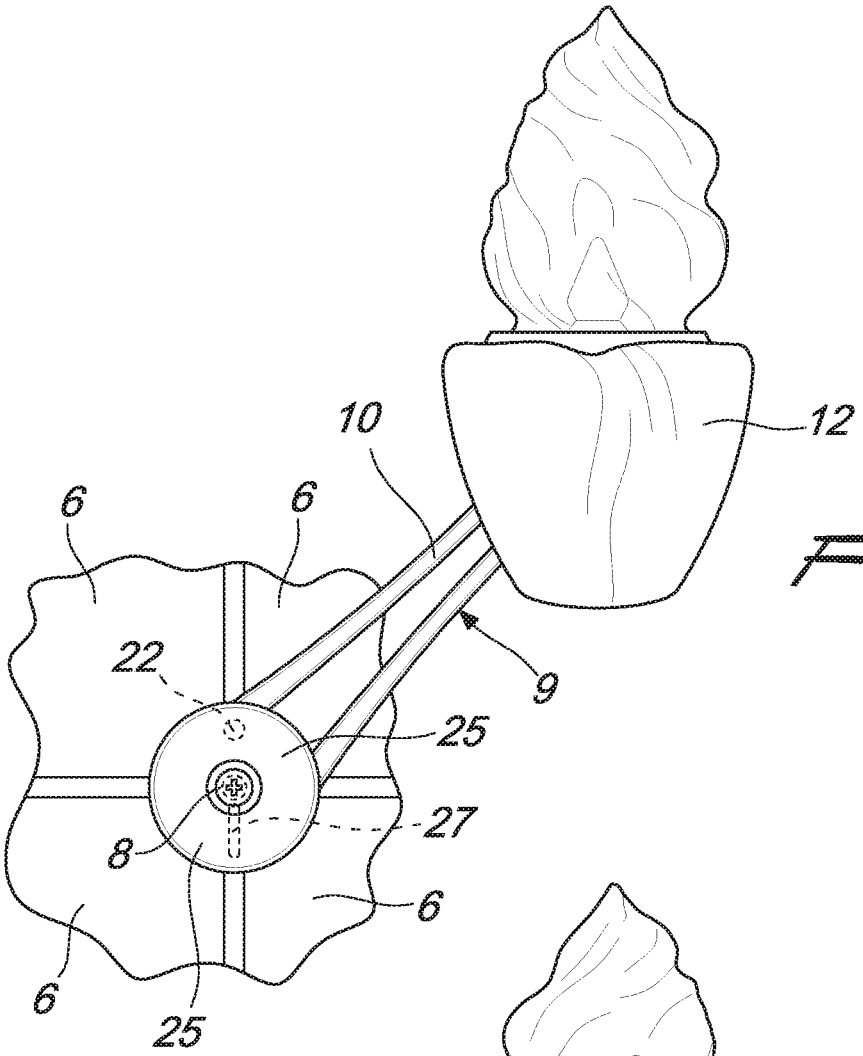
FIG. 10 is a front elevation view of the embodiment of the auxiliary device of FIG. 8.

Conveniently, as in the example in FIG. 8, the supporting body 9*a* can be provided with a stop element 22, which is constituted, for example, by a pin, which protrudes from the face thereof that is directed toward the base structure 2, and which can be inserted into a space 23 which is comprised between the slab 6 that closes the corresponding niche 3 and another slab 6 arranged to close a contiguous niche 3, so that the stop element 22 can engage in abutment against the edges of the slabs 6 between which it is inserted, in order to obtain the rotational locking in place of the supporting body 9*a* about an axis which is substantially perpendicular to the slab 6 and, more specifically, about the axis of the connecting element 8.

It is also possible for the supporting body 9*a* to be paired with an auxiliary element 24 which can be associated with the slab 6 of the corresponding niche 3.

Conveniently, in such case, the auxiliary element 24 can be fixed to the base structure 2 by way of the same connecting element 8 that enables the connection of the supporting body 9*a* to the base structure 2.

For example, as in the embodiment in FIGS. 1-7, the auxiliary element 24 can be constituted by at least one washer 7 or other abutment element, which engages a peripheral region of the slab 6 for the purpose of locking it in place with respect to the base structure 2.

In particular, in this case, conveniently the fixing to the base structure 2 of the slab 6 of the or of each niche 3 is done by way of a plurality of washers 7, which are connected to the base structure 2 and are distributed about the perimeter of the slab 6, so as to engage a peripheral region of the face of the slab 6 that is directed outward, and at least one of such washers 7 is paired with the auxiliary device 9.

Conveniently, the washer 7 that is paired with the auxiliary device 9 has its own hole 7*a*, which is adapted, as is known, for the fixing thereof to the base structure 2 by way of screws or the like, and is arranged aligned with the opening 13 in the supporting body 9*a*, so that it can be passed through by the same connecting element 8 that makes it possible to connect the supporting body 9*a* to the base structure 2.

Advantageously, the supporting body 9*a* of the auxiliary device 9 is arranged so as to face the corresponding washer 7, on the side of the washer that is directed outward, so as to hide it from view.

In this manner, the auxiliary device 9, in addition to providing, by virtue of the supporting arm 10 and the fixing means 11, an effective support for ornamental objects 12 to be paired with the niche 3, makes it possible, by virtue of the supporting body 9*a*, to cover the washers 7 so as to hide them from view.

In this case, conveniently, the supporting body 9*a* has a different and aesthetically more pleasing shape with respect to that of the underlying washer 7, so as to contribute to improving the structure according to the invention from the aesthetic point of view as well.

Figure 3:
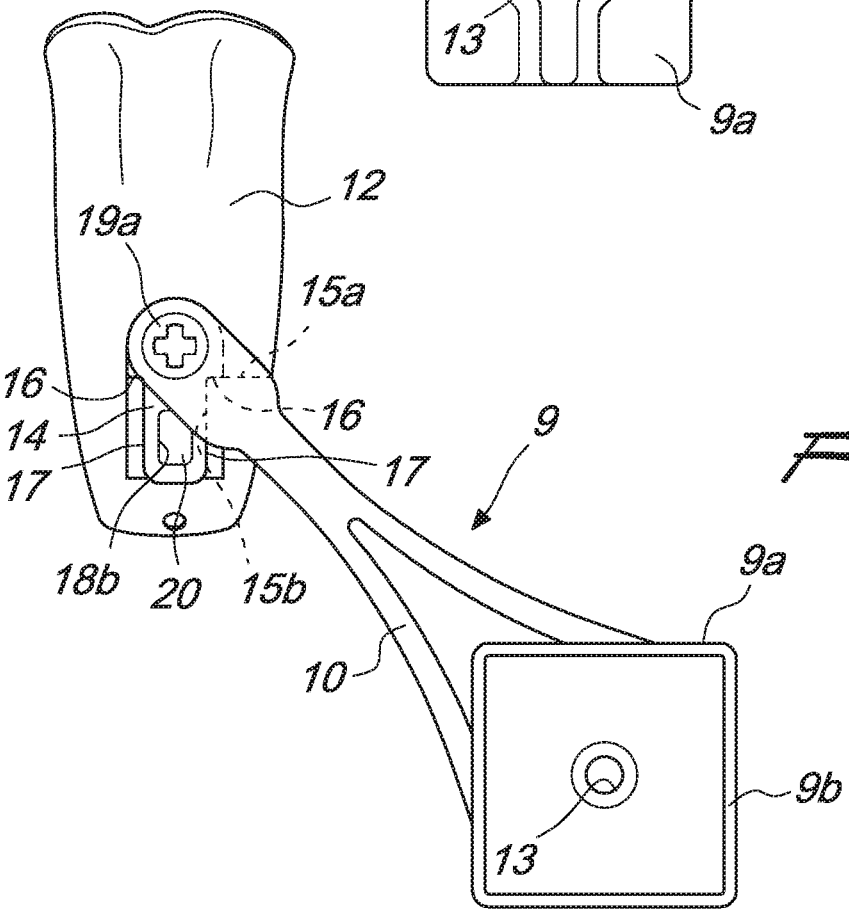
FIG. 3 is a rear view of the auxiliary device.
Figure 4:
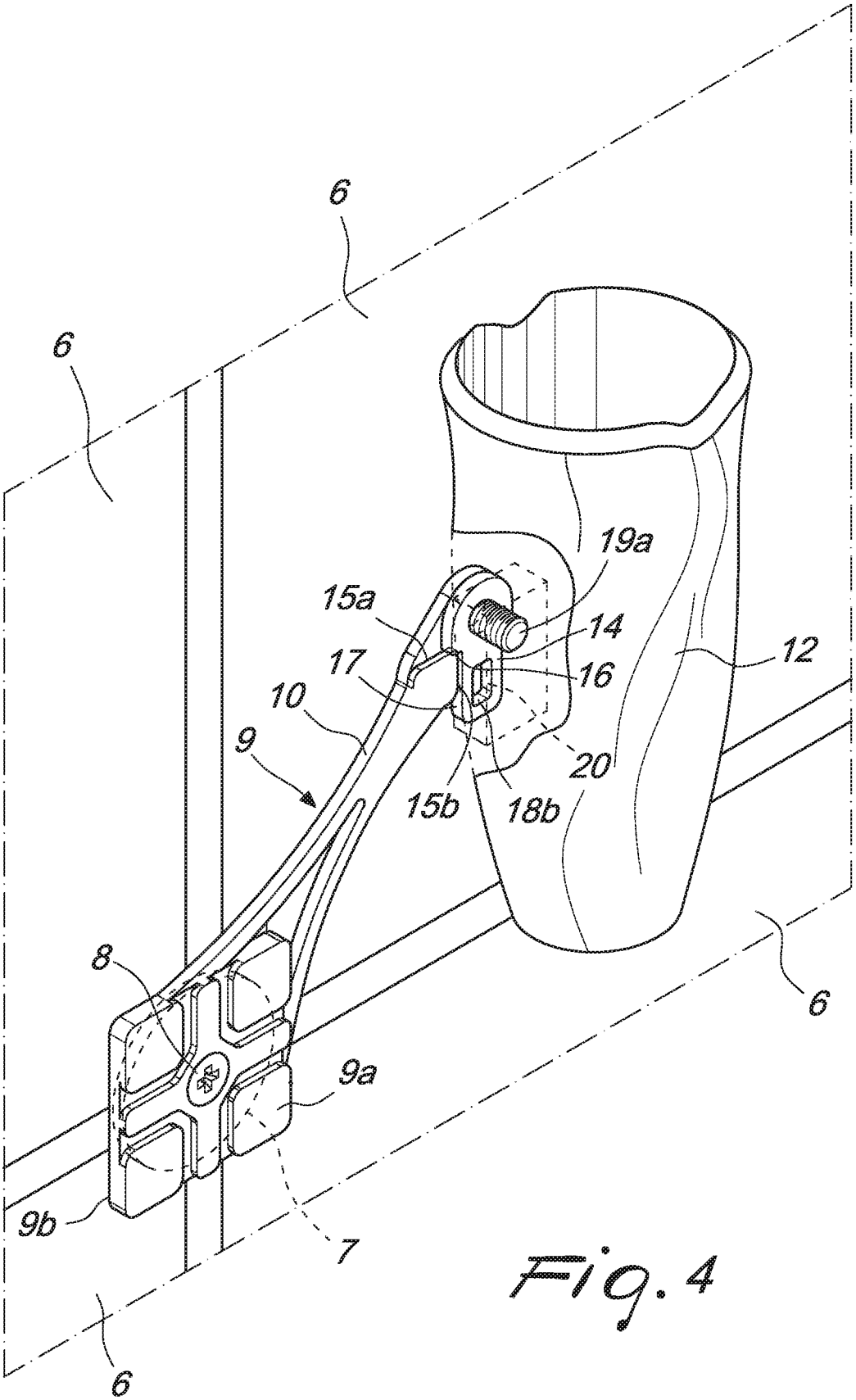
FIG. 4 is a perspective view of a detail of the structure according to the invention with the auxiliary device, highlighted and partially transparent, installed on a structure according to the invention.
Figure 5:
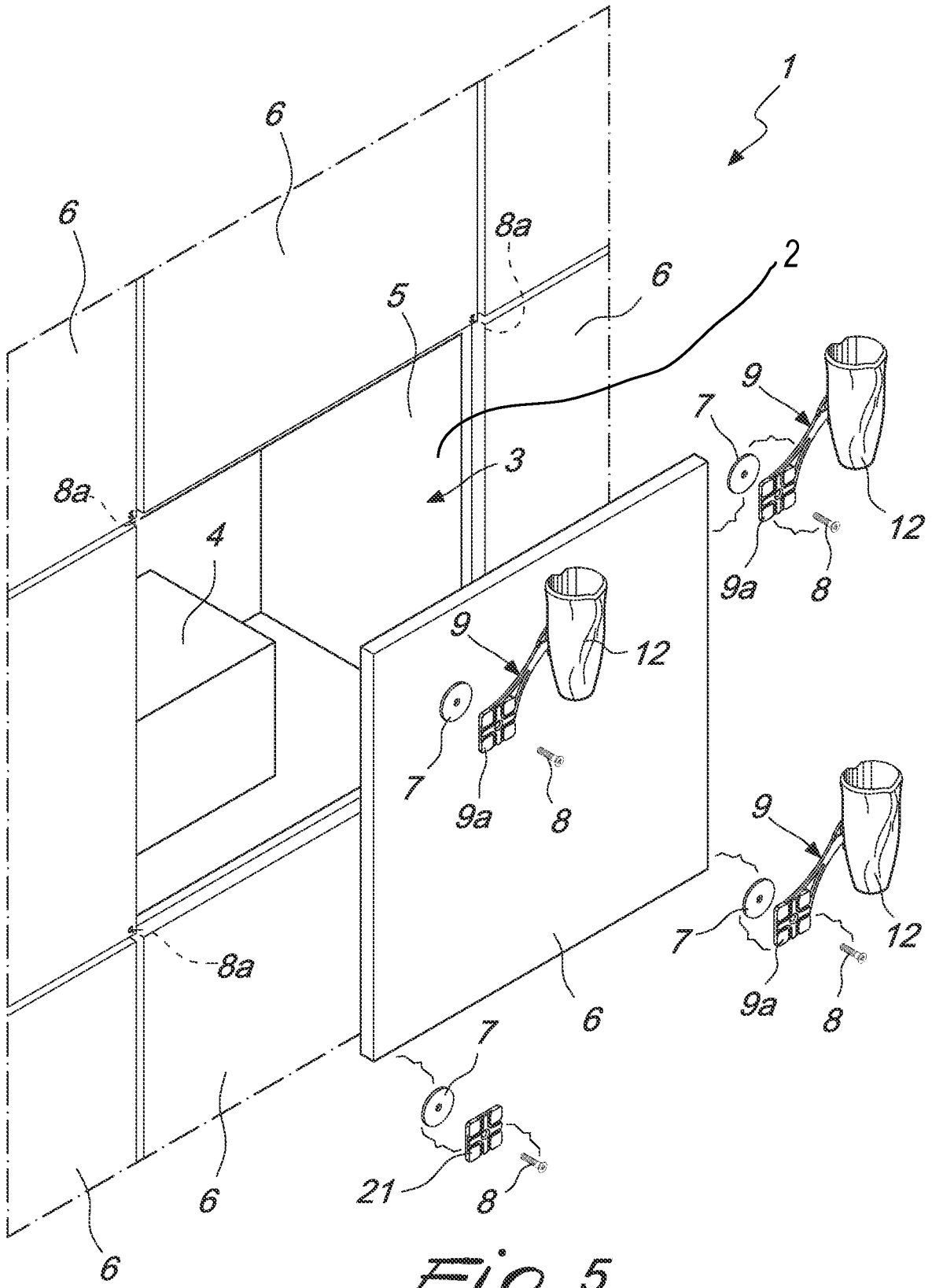
FIG. 5 is a partially exploded perspective view of a portion of the structure according to the invention.

Conveniently, as shown, in particular, in FIG. 3 and in FIG. 4, a peripheral edging 9*b* protrudes from the face of the supporting body 9*a* that is directed toward the corresponding washer 7, and it is designed to arrange itself around the perimeter of the washer 7 and to abut against the slab 6 and any contiguous slabs. It is also possible, optionally, for the peripheral edging 9*b* to be able to engage the edge of the corresponding washer 7 by interlocking.

Figure 6:
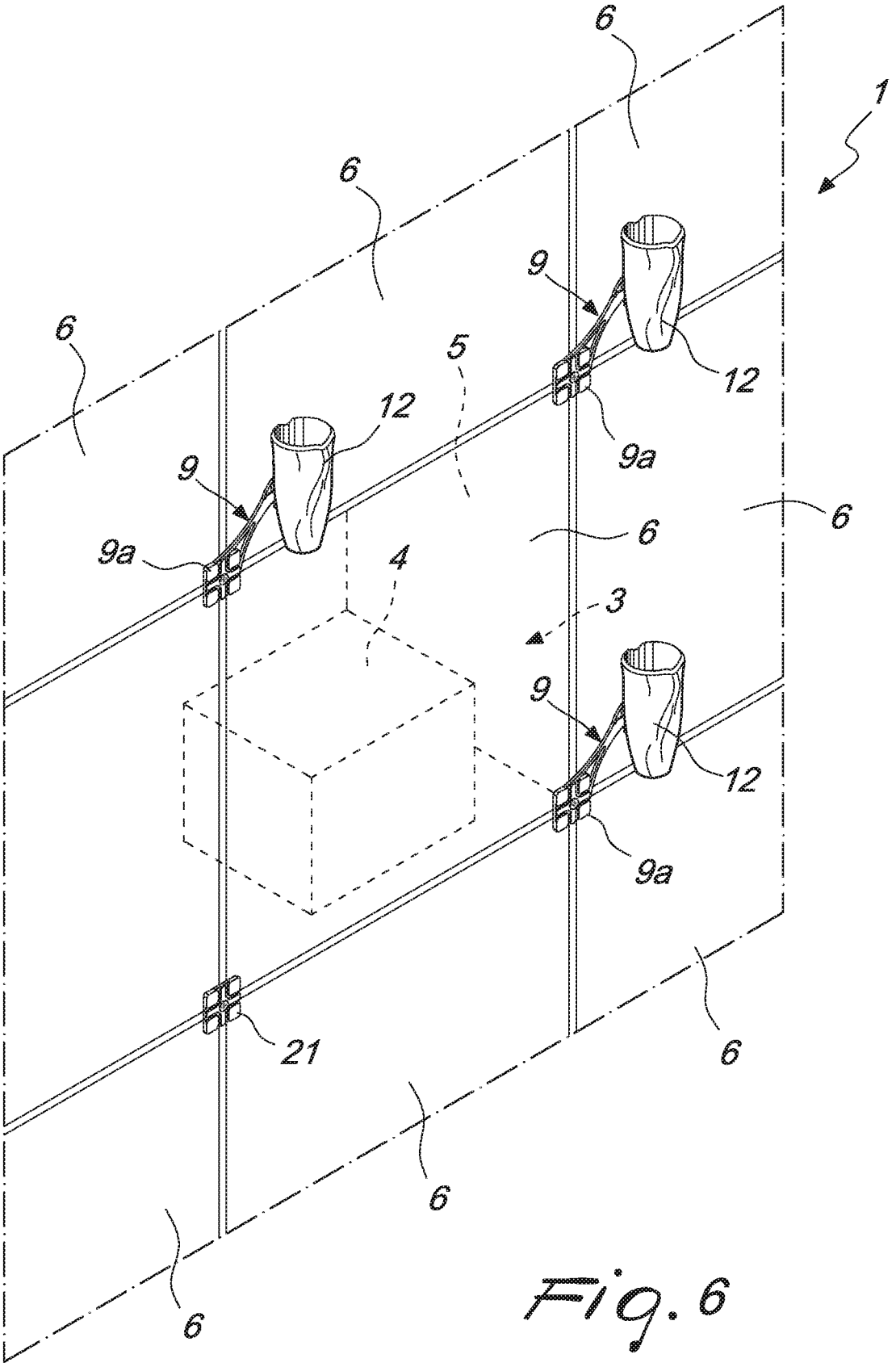
FIG. 6 is a partially transparent perspective view of a portion of the structure according to the invention.
Figure 7:
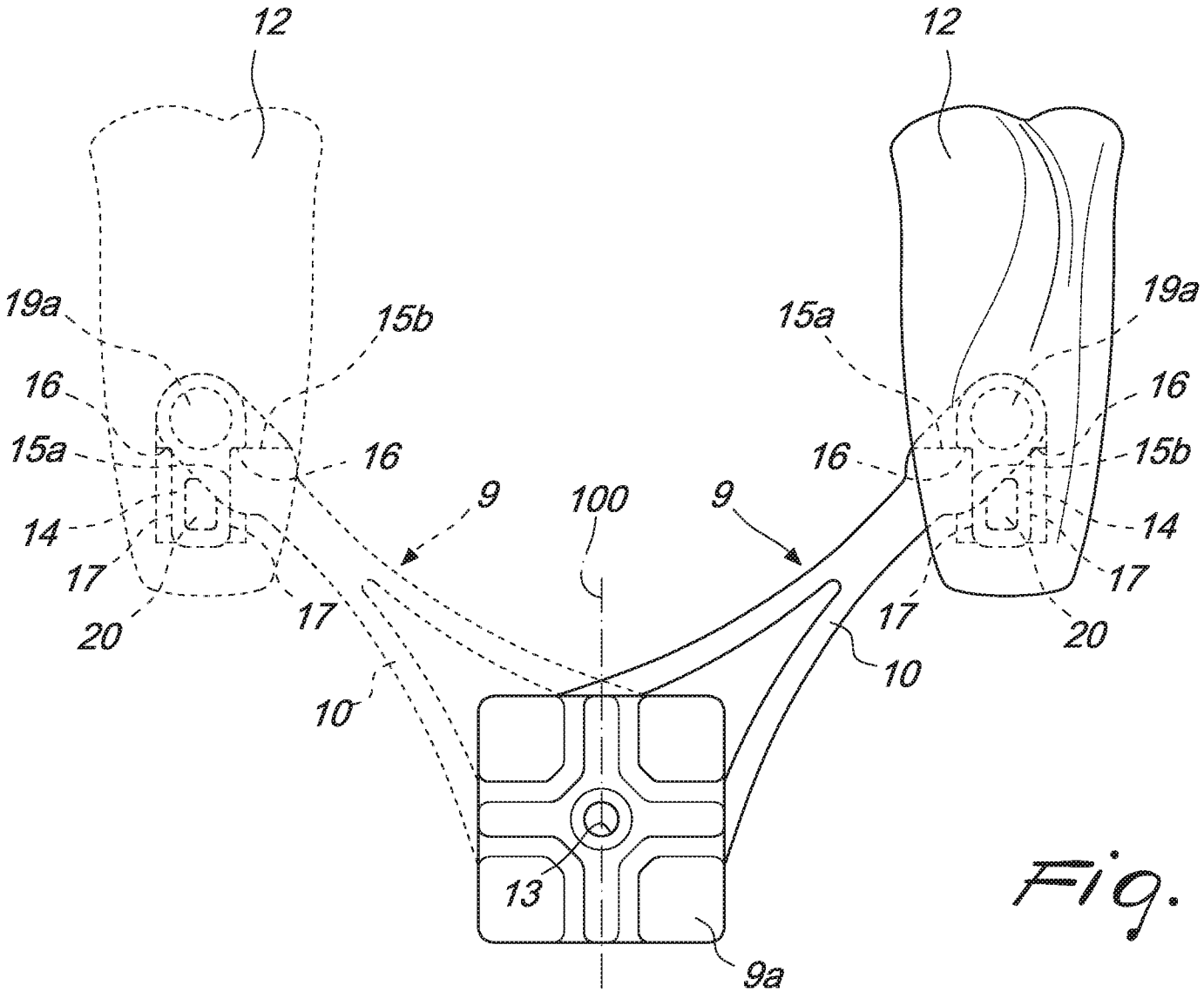
FIG. 7 is a front elevation view of the auxiliary device with dotted lines showing a different possible condition for use of the auxiliary device.

It must be noted that, if the slabs 6 are provided with washers 7, there is no reason why one or more washers 7 cannot be optionally associated also with covering elements like the one designated with 21 in FIG. 6, which have a similar shape to the shape of the supporting body 9*a* of the auxiliary device 9, but which, differently from the auxiliary device 9, lack the supporting arm 10, therefore having only the function of covering and, consequently, hiding the corresponding washer 7 from view.

Alternatively, according to the embodiment of FIGS. 8-11, the auxiliary element 24 can be constituted by at least one boss 25, which is arranged so as to face, with at least one portion thereof, at least one peripheral region of the slab 6.

According to this embodiment, the supporting body 9*a* is preferably arranged so as to rest, with a face thereof, against a peripheral region of the outer face of the slab 6 so as to lock, or at least contribute to locking, the slab 6 to the base structure, and it faces, with its face directed away from the face directed toward the slab 6, the boss 25 that is paired therewith.

In particular, the boss 25 paired with the supporting body 9*a* is superimposed on the supporting body 9*a* so as to cover it from view from outside.

It should be noted that there can be several bosses 25 around the slab 6 of each niche 3, at least one of which is paired with a respective auxiliary device 9.

Conveniently, the boss 25 paired with the auxiliary device 9 has its central hole 25*a*, which is adapted to receive elements for the fixing thereof to the base structure 2, arranged aligned with the opening 13 of the supporting body 9*a* of the auxiliary device 9, so that it can be fixed to the base structure 2 by way of the same connecting element 8 that is used to fix the supporting body 9*a* to the base structure 9.

Advantageously, in order to facilitate the correct positioning of the boss 25 on the supporting body 9*a* of the auxiliary device 9, there is a groove 26 on the supporting body 9*a* which can be engaged by a ridge 27 which is defined on the boss 25.

Advantageously, the above mentioned fixing means 11 which make it possible to fix the ornamental object 12 to the supporting arm 10 comprise at least one anchoring block 14 which is interposed between the supporting arm 10 and the ornamental object 12.

More specifically, the anchoring block 14 can selectively engage the supporting arm 10 in at least two different positions with respect to the supporting body 9*a*.

Figure 11:
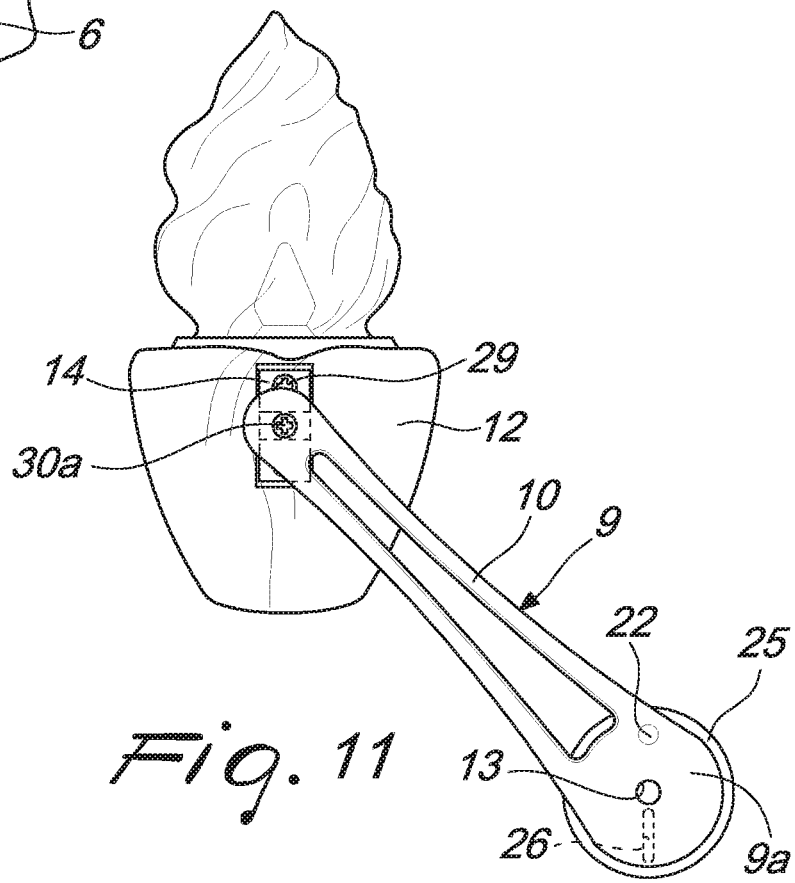
FIG. 11 is a rear view of the embodiment of the auxiliary device of FIG. 8.
Figure 12:
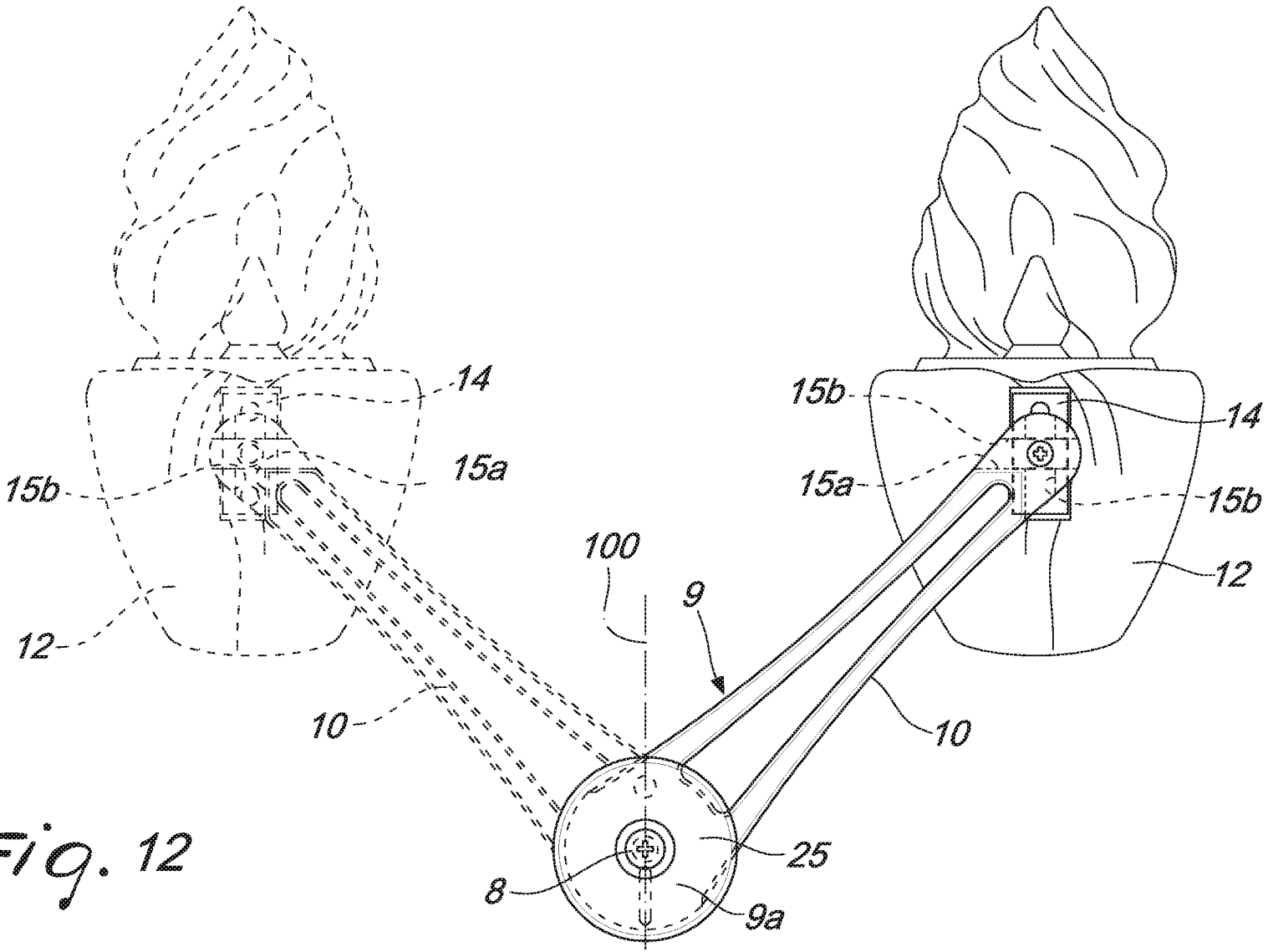
FIG. 12 is a front elevation view of the auxiliary device in the embodiment of FIG. 8 with dotted lines showing a different possible condition for use of the auxiliary device.

In this manner, as highlighted for example in FIG. 6 and in FIG. 11, it is possible to fix the ornamental object 12 to the supporting arm 10 in its normal arrangement of use, independently of the fact that the supporting arm 10 is arranged on one side or on the other, with respect to a central plane 100 that passes through the supporting body 9*a* and is substantially perpendicular to the slab 6.

More specifically, by virtue of the anchoring block 14, it is, for example, possible to arrange the supporting body 9*a* on the base structure 2 with the supporting arm 10 either on the right or on the left of a vertical central plane 100 while always having the possibility to fix the ornamental object 12, positioned in its correct arrangement of use, to the supporting arm 10.

In more detail, the supporting arm 10 is provided with, advantageously, substantially at its free end, at least two locator surfaces 15*a* and 15*b* which extend along respective planes that are substantially perpendicular with respect to the slab 6.

The locator surfaces 15*a* and 15*b* can be engaged in abutment by abutment surfaces 16, 17 which are defined on the anchoring block 14, in order to allow the rotational locking in place of the anchoring block 14, with respect to the supporting arm 10, about an axis that is substantially perpendicular to the slab 6, both in one direction and in the other.

Conveniently, the anchoring block 14 has an elongated shape with at least two seats 18 defined therein which are mutually spaced apart along its extension for the engagement of locking elements for locking the ornamental object 12 in place with respect to the anchoring block 14.

In particular, the anchoring block 14 extends, advantageously, along a direction that is substantially parallel to a substantially vertical direction of extension of the ornamental object 12 in use.

Conveniently, as in the example shown in particular in FIG. 1, the seats 18 defined in the anchoring block 14 comprise, respectively, a through opening 18*a*, which is arranged substantially at one end of the anchoring block 14 and can be passed through by a joining element 19, which connects the supporting arm 10 with the ornamental object 12, and by a coupling slit 18*b*, which extends along the anchoring block 14 and can be engaged by a locking wing or tooth 20 which is integral with the ornamental object 12.

For example, the joining element 19 can be constituted by a screw 19*a* which is inserted into a through hole 10*b*, defined at the free end of the supporting arm 10, and into the through opening 18*a*, defined in the anchoring block 14, and which is screwed into a threaded seat 12*a* which is provided in the ornamental object 12.

According to a different embodiment, like the one shown, for example, in FIG. 8, the seats 18 are constituted by engagement holes 28*a* and 28*b* for screw connection elements 29 which make it possible to fix the anchoring block 14 to the ornamental object 12.

Also with reference to FIG. 8, in the anchoring block 14 there can also be an insertion opening 30 for a joining element 30*a*, which makes it possible to fix the anchoring block to the supporting arm 10.

In particular, the joining element 30*a* is, for example, constituted by a screw or the like which is inserted into the through hole 10*b*, defined at the free end of the supporting arm 10, and which is engaged in a female threading defined in the insertion opening 30.

In the embodiment in FIG. 8, the seats 18 constituted by the engagement holes 28*a*, 28*b* are arranged, advantageously, on mutually opposite sides with respect to the insertion opening 30, and the screw connection elements 29 which pass through the engagement holes 28*a*, 28*b* are screwed into corresponding threaded holes 33 defined in the ornamental object 12.

As shown for example in FIG. 1, according to a possible embodiment, the locator surfaces 15*a* and 15*b* extend substantially at right angles to each other.

Advantageously, again with reference to FIG. 1, at the free end of the supporting arm 10 there can be a lessening of thickness which defines a recess 10*a*, which is delimited by the locator surfaces 15*a* and 15*b* and is designed to receive at least one portion of the anchoring block 14.

Advantageously, in the embodiment shown, in particular, in FIG. 1, the abutment surfaces 16, 17 comprise a pair of first abutment surfaces 16, which are arranged on opposite sides with respect to the main extension of the anchoring block 14 and extend along planes that are perpendicular with respect to the slab 6 and with respect to the main extension of the anchoring block 14, and a pair of second abutment surfaces 17, which extend along opposite longitudinal edges of the anchoring block 14.

With reference to the embodiment in FIG. 8, alternatively the locator surfaces 15*a* and 15*b* can be arranged parallel to and facing each other.

In this case, the abutment surfaces 16 and 17 are defined by the opposite longitudinal edges of an engagement protrusion 34 which protrudes from the face of the anchoring block 14 that is directed toward the supporting arm 10 and can be inserted between the two mutually parallel locator surfaces 15*a* and 15*b*.

Also in this case, there is a first pair of locator surfaces 15*a* and 15*b*, which delimit a first groove 35*a*, and a second pair of locator surfaces 15*a* and 15*b*, which delimit a second groove 35*b* and are arranged at right angles to the locator surfaces 15*a*, 15*b* of the first pair.

Conveniently, the grooves 35*a* and 35*b* intersect with each other and are selectively engageable by the engagement protrusion 34 of the anchoring block 14, so as to enable a different arrangement of the anchoring block 14 with respect to the supporting body 9*a*, according to the position in which it is desired to arrange the supporting arm 10 with respect to the base structure 2 and, more specifically, with respect to a central plane 100, as shown in FIG. 11.

Use of the structure according to the invention is the following.

An auxiliary device 9 is prepared with an ornamental object 12 and, in order to do this, with reference to the embodiment of FIGS. 1-7, initially an anchoring block 14 is coupled to the ornamental object 12 by engaging the locking wing 20 of the ornamental object 12 with the coupling slit 18*b* of the anchoring block 14.

Subsequently, the end of the anchoring block 14 in which the through opening 18*a* is defined is abutted against the free end of the supporting arm 10, by inserting it into the recess 10*a*, and the abutment surfaces 16, 17 of the anchoring block 14 are abutted against the locator surfaces 15*a* and 15*b* which are defined on the supporting arm 10 on the basis of the position that the supporting arm 10 needs to assume with respect to the base structure 2.

The fixing of the ornamental object 12 to the supporting arm 10 is completed by inserting the screw 19*a* into the through hole 10*b* of the supporting arm 10 and into the through opening 18*a* of the anchoring block 14 and then screwing the screw 19*a* into the threaded seat 12*a* provided in the ornamental object 12.

However, with reference to the embodiment of FIGS. 8-11, in order to couple the ornamental object 12 to the auxiliary device 9, first the anchoring block 14 is fixed to the ornamental object 12, by inserting the screw connection elements 29 into the engagement holes 28*a* and 28*b*, which are defined in the anchoring block 14, and screwing them into the threaded holes 33, which are defined in the ornamental object 12; subsequently, the engagement protrusion 34 is inserted into one of the two grooves 35*a*, 35*b*, according to the arrangement the supporting arm 10 will have to assume with respect to the base structure 2, and, lastly, the anchoring block 14 is fixed to the supporting arm 10, by inserting the joining element 30*a* into the through hole 10*b* of the supporting arm and engaging it in the insertion opening 30.

At this point, a slab 6 can be arranged in abutment against the edge of the opening 5 of a corresponding niche 3.

With reference to the embodiment of FIGS. 1-7, a washer 7 is then arranged in abutment against a peripheral region of the outer face of the slab 6, and the supporting body 9*a* of the auxiliary device 9 prepared as described above is faced toward the outer side of the washer 7.

The connecting element 8 is inserted into the opening 13 of the supporting body 9*a* and into the hole 7*a* of the washer 7 and the connecting element 8 is then screwed into the corresponding female thread 8*a* defined in the supporting structure 2, so as to complete the fixing of the auxiliary device 9 to the base structure 2.

On the other hand, in the solution of FIGS. 8-11, the supporting body 9*a* of the auxiliary device 9 prepared previously is arranged in abutment against a peripheral region of the outer face of the slab 6 and a boss 25 is arranged in abutment against the face of the supporting body 9*a* that is directed away from the slab 6; finally, the connecting element 8 is inserted through the central hole 25*a* of the boss 25 and through the opening 13 of the supporting body 9*a* and it is screwed into the corresponding female thread 8*a* defined in the supporting structure 2.

In practice it has been found that the invention fully achieves the intended aim and objects by providing a funerary containment structure for funerary objects that makes it possible to easily apply ornamental objects at the closing slabs of the niches.

The invention, thus conceived, is susceptible of numerous modifications and variations, all of which are within the scope of the appended claims.

Moreover, all the details may be substituted by other, technically equivalent elements.

In practice the materials employed, provided they are compatible with the specific use, and the contingent dimensions and shapes, may be any according to requirements and to the state of the art.

The disclosures in Italian Patent Application No. 102019000011826 from which this application claims priority are incorporated herein by reference.

What is claimed is:

1. A funerary containment structure for funerary objects, which comprises a base structure which defines at least one niche which is designed to contain at least one funerary object and is provided with at least one access opening, which is closed by way of at least one slab which is fixed to said base structure, and further comprising at least one auxiliary device which has a supporting body which is connected to said base structure and supports at least one supporting arm which extends laterally from said supporting body, fixing means being provided for fixing at least one ornamental object to a free end of said at least one supporting arm.

2. The funerary structure according to claim 1, wherein said supporting body is connected to said base structure by way of at least one respective connecting element.

3. The funerary structure according to claim 2, wherein said supporting body is paired with an auxiliary element of said slab which is fixed to said base structure by way of said connecting element.

4. The funerary structure according to claim 3, wherein said auxiliary element comprises at least one washer which engages a peripheral region of said slab.

5. The funerary structure according to claim 3, wherein said auxiliary element comprises at least one boss which faces, with at least one portion thereof, at least one peripheral region of said slab.

6. The funerary structure according to claim 4, wherein said supporting body faces said washer with its face that is directed toward said slab.

7. The funerary structure according to claim 5, wherein said supporting body faces said boss with its face that is directed away from said slab.

8. The funerary structure according to claim 5, wherein said supporting body is provided with a groove which can be engaged by a ridge which is provided on said boss.

9. The funerary structure according to claim 1, wherein said supporting body faces, with at least one portion thereof, at least one peripheral region of a face of said slab that is directed outward.

10. The funerary structure according to claim 1, wherein said supporting body is provided with a stop element which can be inserted between said slab and another, contiguous slab for a rotational locking in place of said supporting body about an axis which is substantially perpendicular to said slab.

11. The funerary structure according to claim 1, wherein said supporting arm extends substantially parallel to an outer face of said slab.

12. The funerary structure according to claim 1, wherein said fixing means comprise at least one anchoring block which is interposed between said supporting arm and said ornamental object and selectively engages said supporting arm in at least two different positions in order to allow a fixing to said supporting arm of said ornamental object in its normal arrangement for use, with said at least one supporting arm arranged either on one side or on another, with respect to a central plane which passes through said supporting body and is substantially perpendicular to said slab.

13. The funerary structure according to claim 12, wherein said supporting arm has, substantially at its said free end, at least two locator surfaces which extend along respective planes which are perpendicular with respect to said slab and are engaged via contact by abutment surfaces which are defined on said anchoring block for the locking in place of said anchoring block, with respect to said supporting arm, in rotation about an axis which is substantially perpendicular to said slab.

14. The funerary structure according to claim 13, wherein said locator surfaces extend substantially at right angles to each other.

15. The funerary structure according to claim 13, wherein said abutment surfaces comprise a pair of first abutment surfaces, which are arranged on opposite sides with respect to a main extension of said anchoring block and extend along planes that are perpendicular with respect to said slab and with respect to the main extension of said anchoring block, and a pair of second abutment surfaces, which extend along opposite longitudinal edges of said anchoring block.

16. The funerary structure according to claim 13, wherein said locator surfaces face each other and are mutually parallel.

17. The funerary structure according to claim 13, wherein said abutment surfaces are defined by opposite longitudinal edges of an engagement protrusion which protrudes from the face of said anchoring block that is directed toward said supporting arm and are inserted between said locator surfaces.

18. The funerary structure according to claim 12, wherein said anchoring block has an elongated shape with at least two seats defined therein which are mutually spaced apart along a main extension thereof for engagement of locking elements for locking said ornamental object in place with respect to said anchoring block.

19. The funerary structure according to claim 18, wherein said seats comprise, respectively, a through opening, which is arranged substantially at one end of said anchoring block and are passed through by a joining element which connects said at least one supporting arm with said at least one ornamental object, and a coupling slit which extends along said anchoring block and is engaged by a locking wing which is integral with said ornamental object.

20. The funerary structure according to claim 12, wherein said anchoring block has at least one insertion opening for engagement of a joining element which is adapted to fix said anchoring block to said supporting arm.

21. The funerary structure according to claim 12, wherein said anchoring block extends along a direction that is substantially parallel to a substantially vertical direction of extension during use of said ornamental object.

22. An auxiliary device for funerary containment structures for funerary objects that comprises a base structure which defines at least one niche which is designed to contain at least one funerary object and is provided with at least one access opening, which is closed by way of at least one slab which is fixed to said base structure, said auxiliary device being characterized in that it comprises supporting body which is connected to said base structure and supports at least one supporting arm which extends laterally from said supporting body, fixing means being provided for fixing at least one ornamental object to the free end of said at least one supporting arm.

* * * * *